US008500363B1

(12) United States Patent
Ries et al.

(10) Patent No.: US 8,500,363 B1
(45) Date of Patent: Aug. 6, 2013

(54) COMPACTOR HAVING CONTROLLABLE EDGE WHEEL SPRAY SYSTEM

(75) Inventors: Michael W. Ries, Coon Rapids, MN (US); Mark L. Norton, Eden Prairie, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/459,393

(22) Filed: Apr. 30, 2012

Related U.S. Application Data

(60) Provisional application No. 61/604,775, filed on Feb. 29, 2012.

(51) Int. Cl.
*E01C 19/23* (2006.01)

(52) U.S. Cl.
USPC ..... 404/129; 404/104; 404/117

(58) Field of Classification Search
CPC ..... E01C 19/4806
USPC ..... 404/104, 117, 129
See application file for complete search history.

(56) References Cited

U.S. PATENT DOCUMENTS

| | | | | |
|---|---|---|---|---|
| 4,009,967 | A * | 3/1977 | Layton | 404/129 |
| 4,463,989 | A | 8/1984 | Kennedy | |
| 4,900,094 | A | 2/1990 | Sergeant | |
| 4,950,102 | A * | 8/1990 | Zeitz | 404/121 |
| 5,222,828 | A * | 6/1993 | Magalski | 404/103 |
| 5,752,782 | A * | 5/1998 | Hulicsko | 404/103 |
| 6,019,544 | A * | 2/2000 | Emerson et al. | 404/104 |
| 6,287,048 | B1 * | 9/2001 | Hollon et al. | 404/84.2 |
| 6,354,761 | B1 * | 3/2002 | Clements | 404/129 |
| 6,499,809 | B1 | 12/2002 | O'Konek | |
| 6,755,482 | B2 | 6/2004 | Johnson | |
| 7,507,053 | B2 * | 3/2009 | Hall | 404/92 |
| 2002/0192025 | A1 | 12/2002 | Johnson | |
| 2004/0018053 | A1 * | 1/2004 | Starry et al. | 404/129 |
| 2010/0008725 | A1 * | 1/2010 | Sampson | 404/128 |
| 2010/0278589 | A1 * | 11/2010 | Verhoff | 404/104 |
| 2011/0272997 | A1 | 11/2011 | Gaertner | |

FOREIGN PATENT DOCUMENTS

| | | | |
|---|---|---|---|
| WO | 2007144678 | A1 | 12/2007 |

* cited by examiner

*Primary Examiner* — Raymond W Addie
(74) *Attorney, Agent, or Firm* — Liell & McNeil

(57) ABSTRACT

A compactor includes a frame and a compacting element coupled to the frame. An edge wheel assembly is also coupled to the frame and is adjustable between a raised configuration and a lowered configuration at which an edge wheel contacts a substrate outboard of the compacting element. The compactor further includes a spray system for the edge wheel, and a control device in control communication with the spray system and configured to command activation of the spray system responsive to detecting lowering of the edge wheel.

20 Claims, 3 Drawing Sheets

COMPACTOR HAVING CONTROLLABLE EDGE WHEEL SPRAY SYSTEM

RELATION TO OTHER PATENT APPLICATION

This application claims priority to provisional patent application 61/604,775, filed Feb. 29, 2012 with the same title.

TECHNICAL FIELD

The present disclosure relates generally to a compactor, and relates more particularly to activating a spray system for an edge wheel of the compactor in response to detected lowering thereof.

BACKGROUND

A variety of different machines are known and widely used for compacting a substrate of material such as paving material and various types of soil. In the context of paving systems, compactors are typically either equipped with metallic cylindrical drums, or pneumatic compacting elements formed from rubber or rubber-like materials. A common practice for certain paving endeavors is to employ both drum compactors and pneumatic compactors in a single paving train.

A drum compactor typically follows behind a paver and "breaks down" paving material placed by the paver upon a sub-grade, performing an initial treatment to render the paving material suitable for subsequent work. A pneumatic compactor may follow behind the leading compactor and performs what is often described as "kneading" of the paving material, to mix and homogenize the paving material in preparation for finishing with another drum compactor.

Paving material is typically comprised of viscous hydrocarbons, and gravel or the like. The paving material is deposited at a relatively high temperature, and cools to harden into a finished product. It is well known that the hot, viscous hydrocarbon constituents of paving material can stick to machinery in a paving train. Where paving material sticks to ground contacting parts of the machinery, such as the rotating drums or tires of compactors, the quality of the paving material mat can suffer, and continued operation of the machinery can itself be compromised.

Various on-board spray systems configured to spray water, release agents and the like, onto rotating compacting elements are used to prevent the paving material from adhering. One conventional spray system is known in the context of drum compactors, and continuously and autonomously sprays liquid onto the compacting drums whenever the compactor is moving. Systems are also known for pneumatic compactors which enable the operator to control the spraying of liquid onto the tires, rather than operating continuously. While such known systems have been sufficient for many years, there remains ample room for improvement in the manner in which liquid spraying systems for compactors are designed and controlled. In a different context, U.S. Pat. No. 4,463,989 to Kennedy is directed to a device for cutting reflector receptacles in pavement. The Kennedy concept proposes a cutter wheel positioned in front of one of the wheels on a truck, and equipped with a water spray system for cooling the cutting wheel.

SUMMARY

In one aspect, a compactor includes a frame and a compacting element coupled to the frame and configured to rotate in contact with a substrate beneath the compactor. The compactor further includes an edge wheel assembly coupled to the frame and including an edge wheel, the edge wheel assembly being adjustable between a first configuration at which the edge wheel is raised, and a second configuration at which the edge wheel is lowered to contact the substrate at a location outboard of the compacting element. The compactor further includes a spray system configured to spray liquid onto the edge wheel to prevent material of the substrate from sticking to the edge wheel, and a control device in control communication with the spray system. The control device is configured to detect lowering of the edge wheel and responsively command activation of the spray system, such that the liquid sprays onto the edge wheel while in contact with the substrate.

In another aspect, an edge wheel system for a compactor includes an edge wheel assembly having an edge wheel, and an actuating mechanism configured to couple to a frame of the compactor and being adapted to adjust the edge wheel assembly between a first configuration at which the edge wheel is raised, and a second configuration at which the edge wheel is lowered to contact a substrate at a location outboard of a rotatable compacting element of the compactor. The system further includes a spray system configured to spray a liquid onto the edge wheel to prevent material of the substrate from sticking to the edge wheel, and a control device in control communication with the spray system. The control device is configured to detect lowering of the edge wheel and responsively command activation of the spray system such that the liquid sprays onto the edge wheel while in contact with the substrate.

In still another aspect, a method of controlling a spray system for an edge wheel configured to contact a substrate at a location outboard of a rotatable compacting element in a compactor includes detecting lowering of the edge wheel, and commanding activation of the spray system responsive to the detected lowering, such that a liquid is sprayed onto the edge wheel while in contact with the substrate, to prevent sticking of material of the substrate to the edge wheel.

DETAILED DESCRIPTION

Figure 1:
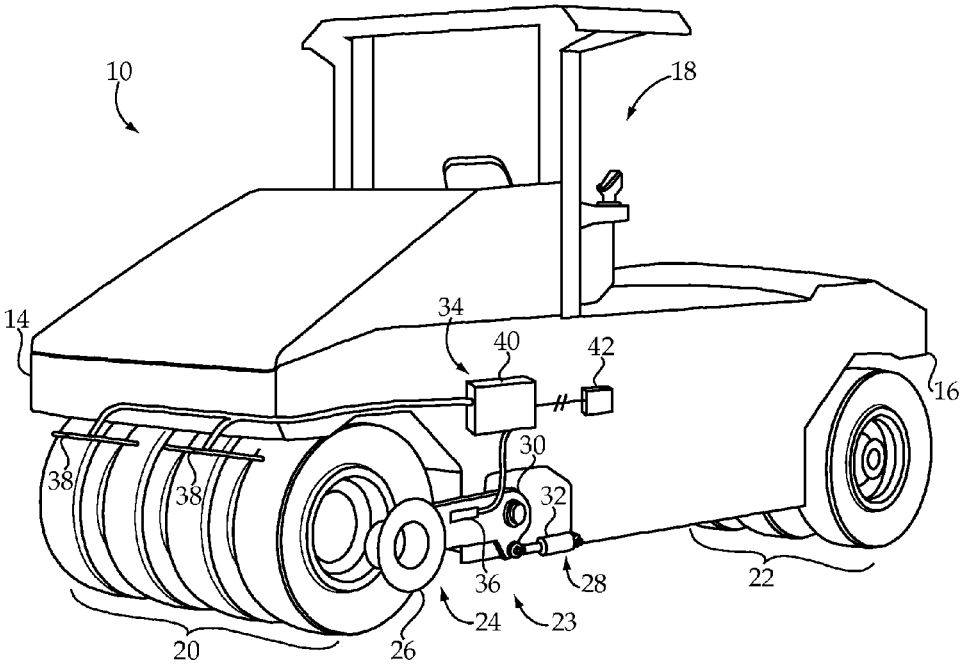
FIG. 1 is a diagrammatic view of a compactor, according to one embodiment.

Referring to FIG. 1, there is shown a compactor 10 according to one embodiment. Compactor 10 includes a frame 12 having a front frame end 16, a back frame end 14, and an operator control station 18 positioned between front frame end 16 and back frame end 14. A rotatable compacting element, and in the illustrated embodiment a plurality of rotatable compacting elements, are coupled to frame 12 and arranged in a front set 22, and a back set 20. Each of rotatable compacting elements 20 and 22 may include a pneumatic compacting element or tire, and front set 22 may include four such tires positioned in parallel, and back set 20 may also include four such tires positioned in parallel. Compactor 10 may further include an edge wheel system 23 having an edge wheel assembly 24 coupled to frame 12. Edge wheel assembly 24 includes an edge wheel 26 which may be used to selectively broaden a compacting footprint of compactor 10, cut a substrate beneath compactor 10, or both. In the illustrated embodiment, only one edge wheel assembly is shown, however, alternatives are contemplated in which as many as four edge wheel assemblies are used, with two associated with each of front and back sets of compacting elements 22 and 20.

Edge wheel system 23 further includes a spray system 34 configured to spray a liquid onto edge wheel 26 to prevent material of the substrate from sticking to edge wheel 26. Those skilled in the art will be familiar with the phenomenon of hot paving material sticking to implements coming in contact therewith, and liquid emulsion or water spray systems are used to prevent sticking of the paving material and the like to avoid these problems. As will be further apparent from the following description, spray system 34 may be controlled in a manner transparent to an operator to automatically activate and deactivate, allowing an operator to focus her attention more on other tasks. To this end, system 23 may further include a control device 42, such as a computer and a computer readable memory storing computer executable code, in control communication with spray system 34. Edge wheel assembly 24 is adjustable between a first configuration at which edge wheel 26 is raised, and a second configuration at which edge wheel 26 is lowered to contact a substrate beneath compactor 10 at a location outboard of one of compacting elements 20, in particular the outermost one of compacting elements 20 shown adjacent to edge wheel assembly 24 in FIG. 1. Control device 42 may be configured to detect lowering of edge wheel 26 and responsively command activation of spray system 34, such that the liquid sprays onto edge wheel 26 while in contact with the substrate.

System 23 may further include an actuating mechanism 28 configured to couple to frame 12 and being adapted to adjust assembly 24 between the first configuration and the second configuration. Actuating mechanism 28 may include a support arm for edge wheel 26 pivotably coupled to frame 12, and an actuator 32 configured to pivot support arm 30 between a first position corresponding to the first configuration of assembly 24 approximately as shown in FIG. 1, and a second position corresponding to the second configuration of assembly 24. Actuator 32 may include a hydraulic actuator, and at the state depicted in FIG. 1 actuator 32 is at an extended position, and adjustable to a retracted position to move support arm 30 to its second position. At the retracted position of actuator 32 edge wheel assembly 24 is in the second configuration and may transmit a retracting force of actuator 32 downwardly into the substrate beneath compactor 10, for purposes of compacting and/or cutting the substrate in a manner that will be familiar to those skilled in the art.

Spray system 34 may further include a fluid supply 40 connected to a sprayer 36 mounted upon support arm 30 and oriented to spray liquid supplied from fluid supply 40 onto edge wheel 26. Spray system 34 may also include one or more additional sprayers 38 configured to spray a liquid supplied from fluid supply 40 onto outer surfaces of compacting elements 20 and 22. The one or more sprayers 38 may be understood as primary sprayers of compactor 10, whereas sprayer 36 may be understood as a secondary sprayer. As further discussed herein, the present disclosure sets forth a unique strategy for making available liquid spray as needed to either or both of sprayers 38 and 36 from common fluid supply 40.

Figure 2:
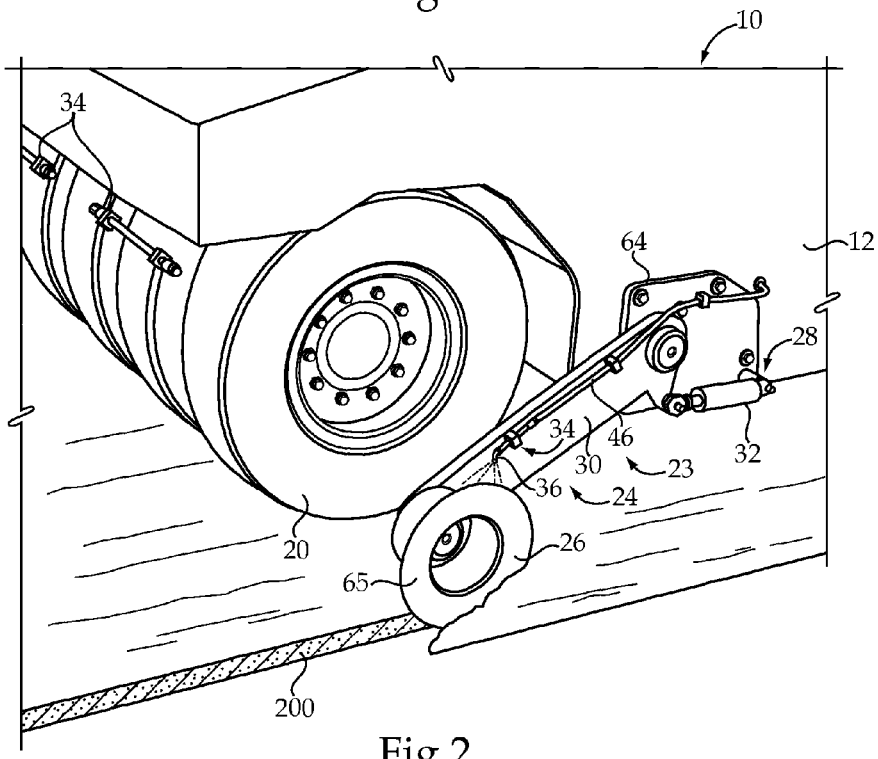
FIG. 2 is a diagrammatic view of a portion of the compactor of FIG. 1, shown with an edge wheel of the compactor engaged with a substrate.

Referring now to FIG. 2, there is shown a portion of compactor 10 as it might appear where edge wheel assembly 24 has been adjusted to its second configuration such that edge wheel 26 contacts a substrate 200 beneath compactor 10. Actuating mechanism 28 has been used to lower edge wheel 26 such that a cutting edge 65 of edge wheel 26 forms a freshly cut clean edge 202 upon substrate 200. Edge 202 might include a straight vertical edge, or a chamfered edge, depending upon the configuration of edge wheel 26. Actuator 32 has been retracted, such that edge wheel 26 transmits a retracting force of actuator 32 downwardly into substrate 200 to enable cutting edge 65 to penetrate. Spray system 34 has been activated such that sprayer 36 sprays the liquid onto edge wheel 26. The liquid may be supplied to sprayer 36 via a fluid conduit 46 which will be understood to extend between sprayer 36 and fluid supply 40, and may be attached to support arm 30. As noted above, actuating mechanism 28 may include pivotable support arm 30, and actuator 32 may be extended and retracted to pivot support arm 30 appropriately to raise or lower edge wheel 26, as the case may be. Support arm 30 may be mounted via a bracket 64 to frame 12. In other embodiments rather than a pivoting support arm, coupled with a hydraulic actuator, some other type of linkage might be used.

Figure 3:
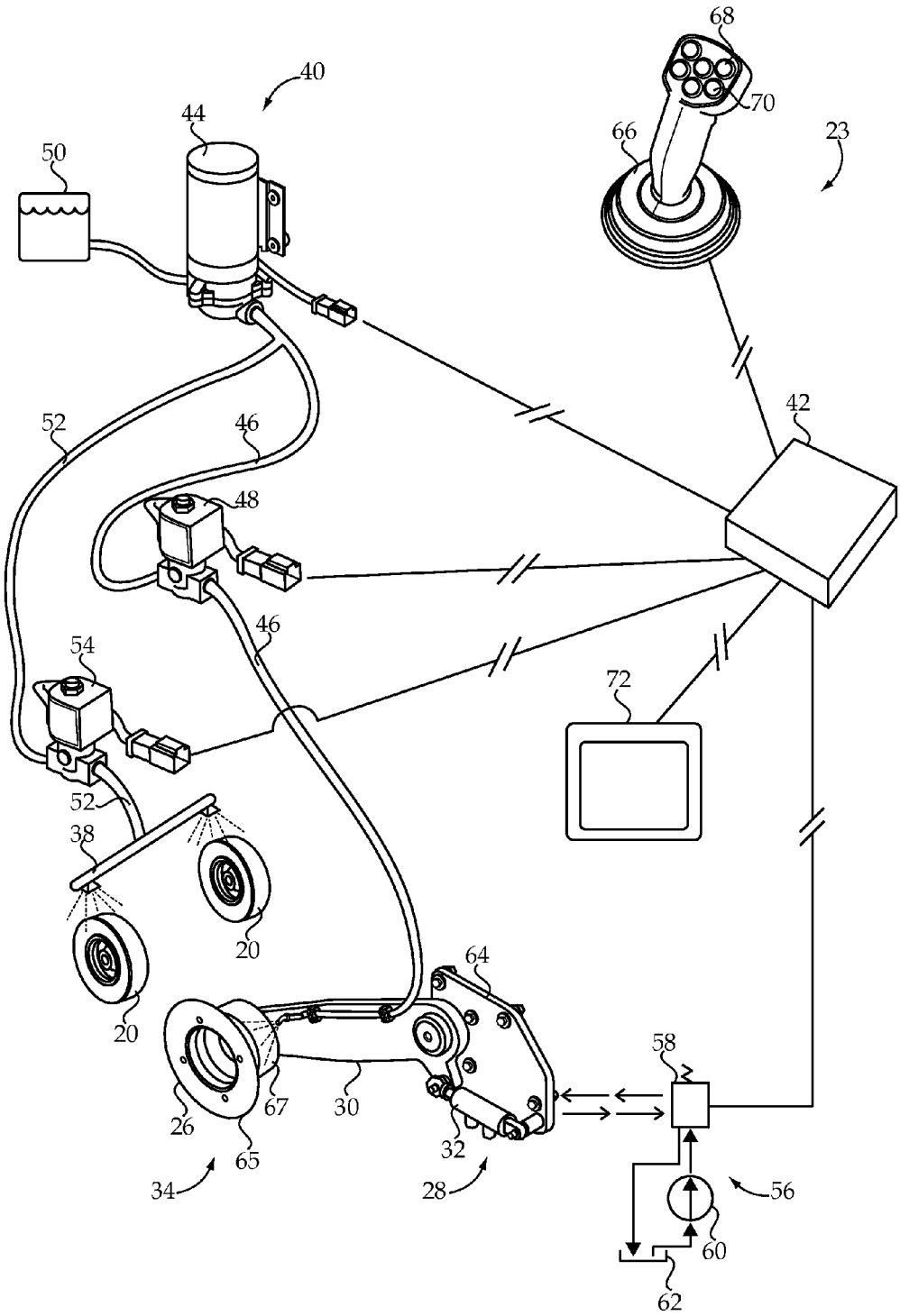
FIG. 3 is a diagrammatic view of an edge wheel system for a compactor, according to one embodiment.

Referring now to FIG. 3, there are shown additional features of system 23, and example connections among the various components. Actuator 32 may be coupled with a hydraulic system 56 of compactor 10, having an electrically actuated valve 58 configured to convey an actuation fluid between actuator 32 and a tank 62. A conventional hydraulic pump 60 is operable to supply the hydraulic fluid at a pressure to actuator 32. Valve 58 may have several different positions, for establishing and interrupting the various connections between actuator 32 and pump 60/tank 62. Control device 42 may be in control communication with valve 58, or multiple valves performing analogous functions, to control actuator 32 and thus raising and lowering of edge wheel 26 for the purposes contemplated herein.

As noted above, fluid conduit 46 may extend between fluid supply 40 and sprayer 36. In a practical implementation strategy, fluid conduit 46 may extend between a pump 44 of fluid supply 40 and sprayer 36, and control device 42 may be configured to command the activation of spray system 34 via outputting a control command to turn on pump 44. In a manner that will be apparent from the following description, control device 42 may further be configured to proactively command the activation of spray system 34 via outputting the control command to turn on pump 44 prior to edge wheel 26 making contact with the substrate beneath compactor 10. Spray system 34 may further include an electrically actuated valve 48 positioned at least partially within fluid conduit 46, and control device 42 may be further configured to command the activation via outputting a control command to valve 48 to open fluid conduit 46 such that liquid pumped via pump 44 can be conveyed to sprayer 36 for spraying onto an outer surface 67 of edge wheel 26. Fluid supply 40 may still further include a tank 50 connected with pump 44, and a second fluid conduit 52 extending between pump 44 and second sprayer 38. A second electrically actuated valve 54 may be positioned at least partially within second fluid conduit 52, and is controllably coupled with control device 42.

Also shown in FIG. 3 is an operator input device 66 in communication with control device, and a display 72 configured for positioning at operator control station 18 and also in communication with control device 42. Operator input device 66 may include a joystick and is configured to control travel direction and travel speed of compactor 10 in a conventional manner. Operator input device 66 may also be used by an operator to request raising and lowering of edge wheel 26. To this end, device 66 may include a first control button 68 which may be depressed to output an edge wheel raise request 68 to control device 42, and a second control button 70 which may be depressed to output an edge wheel lower request to control device 42. It will be recalled that control device 42 is configured to detect lowering and raising of edge wheel 26, and responsively command activation and deactivation, respectively, of spray system 34. There are a number of different ways in which detection of lowering and raising could be accomplished, such as equipping system 23 with sensors to detect a change in position of edge wheel assembly 24, or by monitoring a state of valve 58, for example.

In a practical implementation strategy, control device 42 may be configured to detect the lowering of edge wheel 26 based upon a state of device 66. To this end, device 66 may be understood as having a plurality of different states, including a first state indicating requested lowering and raising of edge wheel 26, such as depression of button 70 for a predetermined time duration, and a second state indicating requested raising of edge wheel 26 such as depression of button 68 for a predetermined time duration. The predetermined time durations might be one second, for instance. In response to detecting the requested lowering of edge wheel 26, control device 42 may command activation of spray system 34 in the manner described herein, and in parallel, or prior, command adjustment of valve 58 such that actuator 32 is retracted to lower edge wheel 26. In response to the request to raise edge wheel 26, control device 42 may responsively command adjusting valve 58 appropriately, and command deactivation of spray system 34. In one embodiment, raising edge wheel 26 via adjusting edge wheel assembly 24 to its first configuration, may occur by commanding a position of activating mechanism 28. In contrast, earlier strategies contemplated moving an edge wheel actuator only so long as a raise command was received, in other words raising the edge wheel only so long as an operator was depressing a button. In the present instance, actuating mechanism 28 may be commanded to adjust all the way to a raised position in response to a single push of button 68, for instance for a predetermined time duration A position sensor might be coupled with assembly 24 to provide feedback confirming the raised position is reached, or the control might take place open loop via controlling valve 58, for example.

Since detection of the request to lower edge wheel 26 may occur prior to edge wheel 26 actually being lowered into contact with the substrate, and in some instances may even occur prior to commencing lowering edge wheel 26, control device 42 may be understood as being configured to detect expected lowering of edge wheel 26. Appropriate control commands for activating spray system 34, such as a command to turn on pump 44 and a command to open valve 48, may be outputted in sufficient time that spraying of liquid via sprayer 36 onto edge wheel 26 commences prior to, or at least upon and coincident with edge wheel 26 making contact with the substrate.

INDUSTRIAL APPLICABILITY

Figure 4:
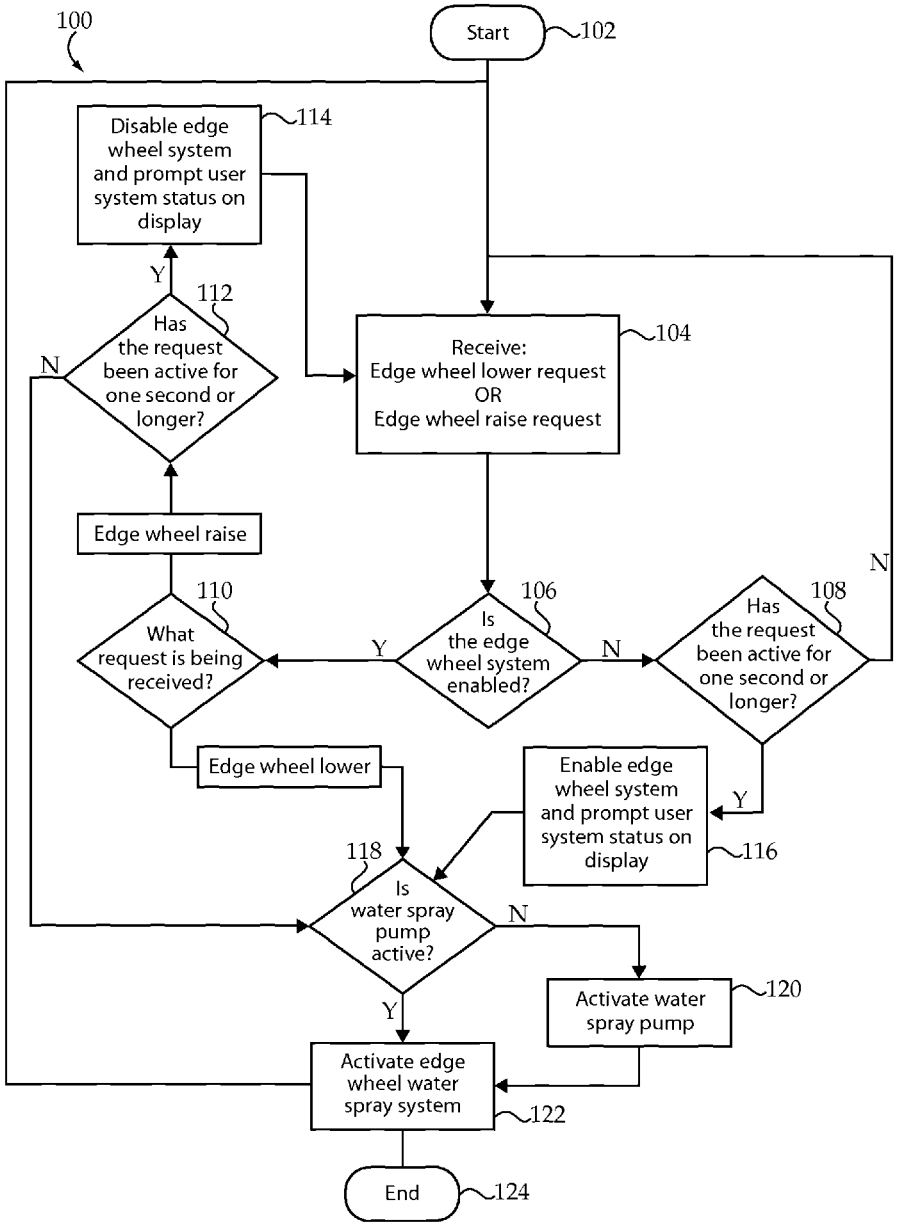
FIG. 4 is a flowchart illustrating an example control process according to one embodiment.

Referring to the drawings generally, but in particular now to FIG. 4, there is shown a flowchart 100 illustrating an example control process according to one embodiment. The process of flowchart 100 may start at step 102, and proceed to step 104 to receive an edge wheel down/lower request or an edge wheel up/raise request, for instance receiving such requests encoded in signals transmitted from device 66 to control device 42, or received via interrogating device 66 with control device 42. From step 104, the process may proceed to step 106 to query whether edge wheel system 23 is enabled. Upon starting compactor 10, for instance turning its ignition key, system 23 may default to a disabled state, whereas after starting compactor 10 system 23 may remain in an enabled state once system 23 has been used. If, at step 106, system 23 is not enabled, the process may proceed to step 108 to query whether the request has been active for a predetermined time duration such as one second, or longer. If no, the process may loop back to execute step 104 again. If yes, the process may proceed to step 116 to enable system 23 and prompt user system status on display 72. Display 72 might display an icon indicating the enabled state, or illuminate a light, for instance.

If, at step 106, system 23 is enabled, the process may proceed to step 110 to query what request is being received. If the request is an edge wheel up/raise request, the process may proceed to step 112 to query whether the request has been active for a predetermined time duration such as one second, or longer. If yes, the process may proceed to step 114 to disable system 23 and prompt user system status on display 72, and thenceforth proceeding to execute step 104 again. If the request has not been active for one second or longer at step 112, or another predetermined time duration, the process may proceed to step 118.

From step 116, from step 112 where the result of step 112 is false, or where an edge wheel down/lower request is determined at step 110, the process arrives at step 118 to query whether the water spray pump is active. At step 118, it may be determined whether pump 44 is turned on and pumping, for example. If, at step 118 pump 44 is active, the process may proceed to step 122 to activate valve 48. If pump 44 is not active at step 118, the process may proceed to step 120 to activate pump 44, and then to step 122. It should be appreciated that steps 122 and 120 may be executed in parallel, but might also take place sequentially. Either way, the result of activating valve 48, in other words opening conduit 46 between pump 44 and sprayer 36, will typically be the spraying of liquid onto edge wheel 26. From step 122, the process may loop back to start again, or may end at step 124.

As noted above, compactor 10 may be a pneumatic compactor in which primary sprayer 38 sprays a liquid such as water onto compacting elements 20 and 22. In pneumatic compactors employing tires made from rubber or rubber-like materials, it is typically unnecessary to spray the tires continuously to prevent sticking of paving material thereto. Accordingly, sprayer 38 may be deactivated much of the time while compactor 10 is working paving material. Sprayer 38 may thus be idle, and valve 54 may be closed, upon and while pump 44 is turned on and valve 48 opened to spray edge wheel 26. This contrasts with certain other compactor spray system designs such as those known from drum compactors, where a water spray system for the drums operates continuously so long as the compactor is moving. Since continuous spray of compacting elements in a pneumatic compactor may not be needed, it will typically be desirable to turn pump 44 off so long as no water spray to either of compacting elements 20, 22 or edge wheel system 23 is needed. By employing control logic that queries a state of pump 44, edge wheel system 23 may be sprayed independently of spraying compacting elements 20, 22, without the need for a separate pump. In other words, while embodiments utilizing two independent pumps for sprayer 36 and sprayer 38 may well fall within the scope of the present disclosure, the embodiments specifically discussed and illustrated herein would likely provide advantages over such a system in terms of number of parts, complexity, and expense. This strategy can also enable installation of edge wheel system 23 as a parasitic subsystem of an existing spray system 34 resident on an existing compactor.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A compactor comprising:

a frame;

a compacting element coupled to the frame and configured to rotate in contact with a substrate beneath the compactor;

an edge wheel assembly coupled to the frame and including an edge wheel, the edge wheel assembly being adjustable between a first configuration at which the edge wheel is raised, and a second configuration at which the edge wheel is lowered to contact the substrate at a location outboard of the compacting element;

a spray system including a fluid supply, a first sprayer configured to spray a liquid from the fluid supply onto the edge wheel to prevent material of the substrate from sticking to the edge wheel, and a second sprayer configured to spray the liquid onto the compacting element;

the spray system further including a first electrically actuated valve positioned fluidly between the fluid supply and the first sprayer and having an open position and a closed position, and a second electrically actuated valve positioned fluidly between the fluid supply and the second sprayer and having an open position and a closed position; and a control device in control communication with each of the first and second electrically actuated valves, the control device being configured to detect lowering of the edge wheel and responsively command activation of the spray system, such that the spray system is adjusted from a first state in which both the first and second electrically actuated valves are closed, to a second state in which the second electrically actuated valve is closed and the first electrically actuated valve is open and the liquid sprays onto the edge wheel while in contact with the substrate.

2. The compactor of claim 1 wherein the control device is further configured to detect expected lowering of the edge wheel and responsively command the activation of the spray system such that the liquid sprays onto the edge wheel upon making contact with the substrate.

3. The compactor of claim 1 wherein the edge wheel assembly further includes a support arm for the edge wheel coupled to the frame, and an actuator configured to pivot the support arm to adjust the edge wheel assembly between the first and second configurations.

4. The compactor of claim 3 wherein the actuator is at an extended position, and is adjustable to a retracted position at which the edge wheel assembly is in the second configuration and the edge wheel transmits a retracting force of the actuator downwardly into the substrate.

5. The compactor of claim 1 wherein the spray system further includes a pump, and the control device is further configured to command the activation via outputting a control command to turn on the pump prior to the edge wheel making contact with the substrate.

6. The compactor of claim 5 wherein the spray system further includes a fluid conduit extending between the pump and the first sprayer, the first sprayer being oriented to spray the liquid onto an outer surface of the edge wheel, and the first electrically actuated valve positioned at least partially within the fluid conduit.

7. The compactor of claim 6 wherein the spray system further includes a tank connected with the pump, a second fluid conduit extending between the pump and the second sprayer, and the second electrically actuated valve being positioned at least partially within the second fluid conduit.

8. The compactor of claim 7 wherein the compacting element is one of a plurality of pneumatic compacting elements.

9. The compactor of claim 8 wherein the edge wheel includes an edge cutting wheel.

10. An edge wheel system for a compactor comprising:

an edge wheel assembly including an edge wheel, and an actuating mechanism configured to couple to a frame of the compactor and being adapted to adjust the edge wheel assembly between a first configuration at which the edge wheel is raised, and a second configuration at which the edge wheel is lowered to contact a substrate at a location outboard of a rotatable compacting element of the compactor;

a spray system including a sprayer configured to spray a liquid from a fluid supply onto the edge wheel to prevent material of the substrate from sticking to the edge wheel, a first fluid conduit configured to fluidly connect the sprayer with the fluid supply, a second fluid conduit fluidly connected with the first fluid conduit and configured to fluidly connect a second sprayer with the fluid supply, and a first and a second electrically actuated valve positioned at least partially within the first fluid conduit and the second fluid conduit, respectively, and each having an open position and a closed position; and a control device in control communication with each of the first and second electrically actuated valves, the control device being configured to detect lowering of the edge wheel and responsively command activation of the spray system, such that the spray system is adjusted from a first state in which both the first and second electrically actuated valves are closed, to a second state in which the first electrically actuated valve is open and the liquid sprays onto the edge wheel while in contact with the substrate.

11. The system of claim 10 wherein the actuating mechanism includes a support arm and an actuator coupled to the support arm, and the spray system further includes a sprayer mounted to the support arm and oriented to spray the liquid onto an outer surface of the edge wheel.

12. The system of claim 11 wherein the spray system further includes a tank, and a pump connected to the tank.

13. The system of claim 12 wherein the control device is further configured to command the activation of the spray system via outputting control commands to the pump and to the first electrically actuated valve.

14. The system of claim 11 further comprising an operator input device in communication with the control device and having a plurality of different states, and wherein the control device is configured to detect the lowering based on a state of the operator input device.

15. The system of claim 14 wherein the operator input device has a first state indicating requested lowering of the edge wheel, and a second state indicating requested raising of the edge wheel, and wherein the control device is further configured to command deactivation of the spray system responsive to the requested raising of the edge wheel.

16. The system of claim 15 wherein the control device is further configured to command a position of the actuating mechanism responsive to the requested raising.

17. A method of controlling a spray system for an edge wheel configured to contact a substrate at a location outboard of a rotatable compacting element in a compactor comprising the steps of:

detecting lowering of the edge wheel;

commanding activation of the spray system responsive to the detected lowering, such that a liquid is sprayed via a first sprayer onto the edge wheel while in contact with the substrate, to prevent sticking of material of the substrate to the edge wheel, and while a second sprayer configured to spray the rotatable compacting element is deactivated and the rotatable compacting element rotates in contact with the substrate.

18. The method of claim 17 further comprising a step of turning on a pump, and opening a valve positioned fluidly between the pump and the first sprayer, responsive to the commanded activation and prior to contacting the edge wheel with the substrate.

19. The method of claim 18 wherein the step of detecting lowering of the edge wheel includes detecting an expected lowering based on a state of an operator input device.

20. The method of claim 17 wherein the compactor includes a pneumatic compactor having a primary sprayer connected to the pump and configured to spray the liquid onto the rotatable compacting element, and wherein each of the turning on and opening steps occurs while the primary sprayer is deactivated.

* * * * *